United States Patent [19]

Dewing et al.

[11] 4,188,887

[45] Feb. 19, 1980

[54] MULTI-DIRECTIONAL CRANE TRUCK

[75] Inventors: Kenneth F. Dewing; Donald C. Harlander, both of Benicia; Ralph O. Hughes, Walnut Creek, all of Calif.

[73] Assignee: McKay International Engineers, Benicia, Calif.

[21] Appl. No.: 892,205

[22] Filed: Mar. 31, 1978

[51] Int. Cl.[2] ..... B61D 15/02; B61F 7/00; B61F 13/00; B66C 9/06

[52] U.S. Cl. ..... 105/163 R; 105/177; 182/36; 212/22

[58] Field of Search ..... 105/163 R, 177, 163 SK; 182/36, 37; 212/22

[56] References Cited

U.S. PATENT DOCUMENTS

| | | | |
|---|---|---|---|
| 1,280,238 | 10/1918 | King et al. | 105/163 R X |
| 3,450,062 | 6/1969 | Pradon | 105/163 R X |
| 3,918,682 | 11/1975 | Despalmes | 105/177 X |

FOREIGN PATENT DOCUMENTS

| | | | |
|---|---|---|---|
| 904148 | 8/1962 | United Kingdom | 105/177 |

*Primary Examiner*—Joseph F. Peters, Jr.
*Assistant Examiner*—Howard Beltran
*Attorney, Agent, or Firm*—Lothrop & West

[57] ABSTRACT

A crane mover is arranged to transfer a crane, such as a dockside crane, around a curve from one straight track to another straight track. The mover runs on rails and carries synchronized jacks engageable with lift pads on the crane. The mover also carries lips on the jack stems to engage and restrict excess rocking movement of the crane wheel equalizers. All of the mover actions and motion are preferably controlled from an operator station on the crane mover.

7 Claims, 4 Drawing Figures

MULTI-DIRECTIONAL CRANE TRUCK

BRIEF SUMMARY OF THE INVENTION

In some of the more modern installations of large cranes, particularly for use on docks for loading and unloading containers to and from ships, the customary arrangement is to have the cranes operate in straight paths alongside the edges of the docks. In some instances, due to the dock arrangement, it is desired to have a crane move on other tracks, perhaps at a rather substantial angle to the first straight track. Without specially building the crane and without incurring a great deal of additional expense, it is not possible to accommodate some of the crane requirements under these conditions. It is, therefore, now proposed to provide an auxiliary crane mover that is installable in present locations as well as in new installations and has the effect of moving the crane from one set of straight tracks to another set of straight tracks at an angle thereto, meanwhile maintaining the stability and attitude of the crane and taking care of any otherwise detrimental rocking movement of the crane wheel equalizers.

DETAILED DESCRIPTION

Figure 1:
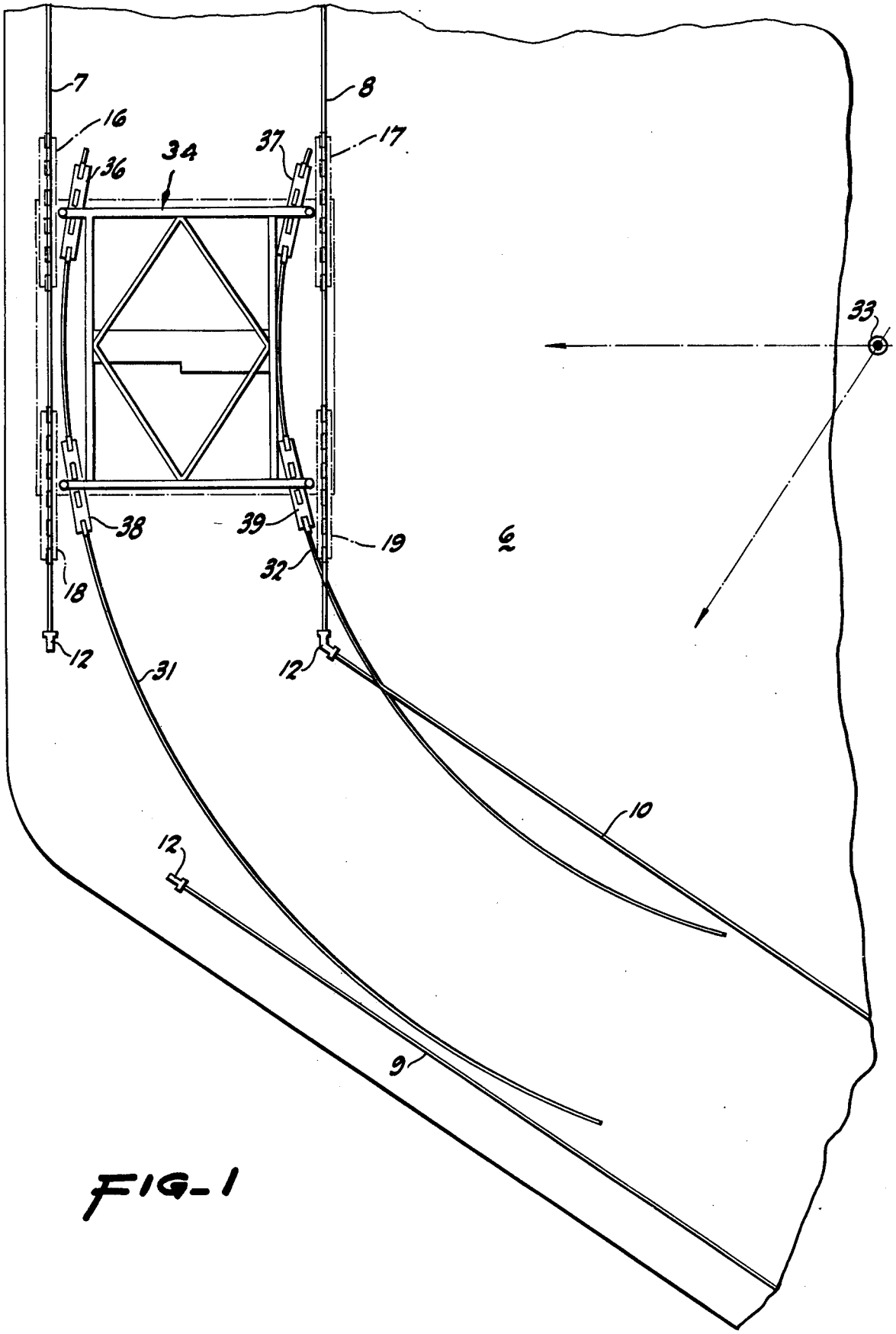
FIG. 1 is a plan showing in cross-section on a generally horizontal plane a dock laid out with a pair of relatively straight tracks, each disposed at an angle to another pair of straight tracks along with some curved tracks utilized in connection with the instant crane mover.

In a typical environment for the use of the present crane mover, there is, as shown in FIG. 1, a dock generally designated 6, having a first pair of straight rails 7 and 8 laid thereon and having a second pair of rails 9 and 10 laid thereon with the same gauge as the rails 7 and 8 but disposed at a substantial angle thereto. The rails conveniently have stops 12 at their respective ends, so there is no direct communication, for various reasons, between the rail pair 7 and 8 and the rail pair 9 and 10.

Operating on the rails 7 and 8, for example, is a crane represented herein by a number of straight, multiwheel trucks 16, 17, 18 and 19. These trucks are generally similar and are appropriately incorporated each beneath a leg 21 (FIG. 3) of the crane frame in the standard fashion. Each of the trucks, such as 16, is an articulated member having a plurality of rail-engaging wheels 22 thereon. It is customary to connect the wheels 22 in longitudinal pairs, each pair of wheels being joined by an equalizer beam 23 (FIG. 3), itself connected to either an intervening frame or directly to the leg of the crane through a pivot pin 24 designed to allow rocking movement about a transverse axis 26. Thus, the weight of one portion of the crane is evenly disposed over the various wheels of the truck 19 (FIG. 3) and so is appropriately imposed on the subjacent rail 8, for example. All four corners of the crane are normally constructed substantially as described, and normally the crane as a whole is supported on and moves to and fro and along the rails 7 and 8.

Pursuant to the present arrangement, there is provided an additional pair of rails 31 and 32. These are curved about a center 33 and are symmetrically disposed with respect to the rail pair 7 and 8 and to the pair 9 and 10, although the gauge of the rails 31 and 32 in this embodiment is substantially less than that of the other rail pairs. In effect, the curvature of the rails 31 and 32 is symmetrical with respect to the rail pair 7 and 8 as well as the rail pair 9 and 10. Wherein the various rails may intersect or cross, the usual rail intersection construction is employed.

Figure 2:
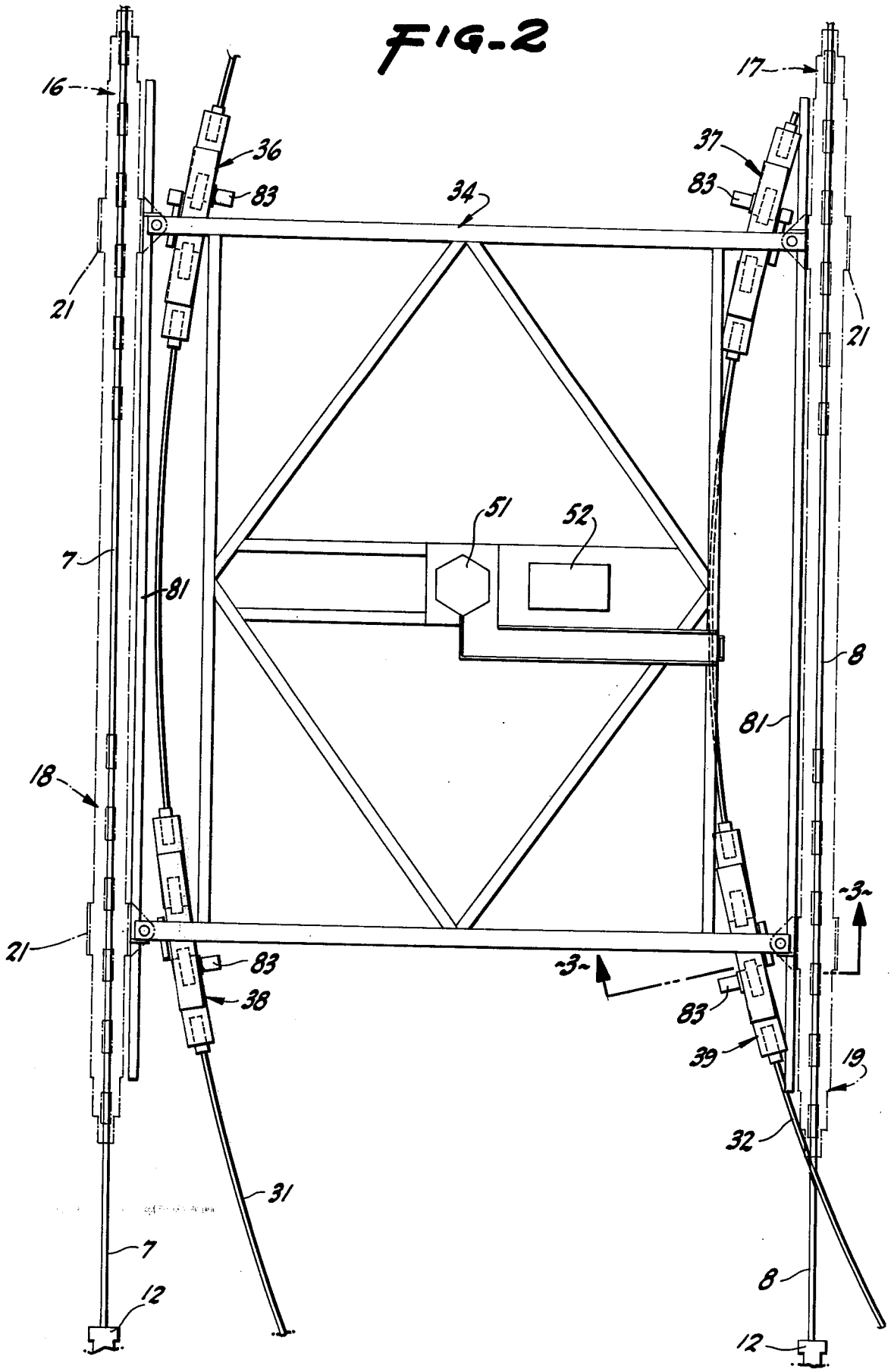
FIG. 2 is a cross-section similar to FIG. 1 and taken in a generally horizontal plane a short distance above the ground but to a scale substantially enlarged from FIG. 1, portions being broken away for that reason.

Designed to operate on the rails 31 and 32 is a crane mover having a crane mover frame 34 made up of the customary structural shapes and angles. The mover frame 34 extends laterally above individual, multiwheel mover trucks 36, 37, 38 and 39. These are substantially identical and are arranged so that their length in plan is slightly curved substantially above the rails 31 and 32. The mover trucks bear angular relationships to the rectangular mover frame 34. While the trucks can be pivoted on the mover frame about vertical axes if desired, it is not necessary that such construction be employed. Rather, the truck frames can be fixed at the appropriate angles with respect to the mover frame 34, as shown in FIG. 2.

Each of the mover trucks includes equalizer beams 41 (FIGS. 3 and 4) connected to the frame through pivot pins 42 allowing turning about axes 43 in a generally horizontal plane and all converging on the appropriate center 33. The equalizer beams 41 carry at least one pair of wheels 44, each resting on one of the subjacent rails 31 or 32. In this fashion the mover frame 34 is supported at four distinct zones and is able to bear all of the weight or load which might be imposed on it by the crane and load.

There is an appropriately located, central control station 51 (FIG. 2) usually near the center of the mover frame 34 and adjacent a power source 52 from which appropriate drive and operating energy can be taken mechanically, electrically or hydraulically or by some combination of those forms. An operator at the station 51 has complete control of the crane mover mechanism. While this control station can be consolidated with the usual control station for the crane itself, it is usually found advisable to provide a separate control station such as 51. In the present instance, the control station governs the transmission of power, hydraulically, to a drive motor 53 (FIG. 3) located conveniently on part of the mover frame and driving a bevel gear 54 meshing with a gear 56 on a drive shaft 57 for one of a number of jacks 58, the shaft 57 being connected to similar shafts through bevel gears (not shown) to other jacks 58 on the respective corners of the mover frame 34.

Figure 3:
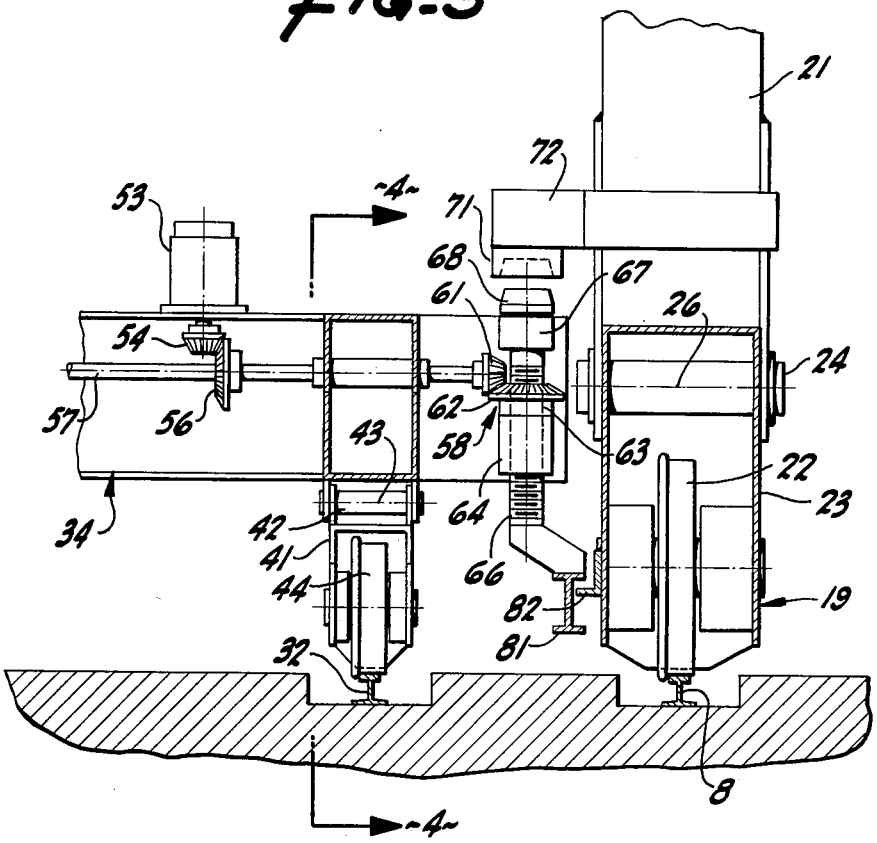
FIG. 3 is a detail in cross-section on the planes 3—3 of FIG. 2, some of the adjacent portions of the structure being omitted for clarity in illustration and with the crane and the crane mover both in engagement with their rails.
Figure 4:
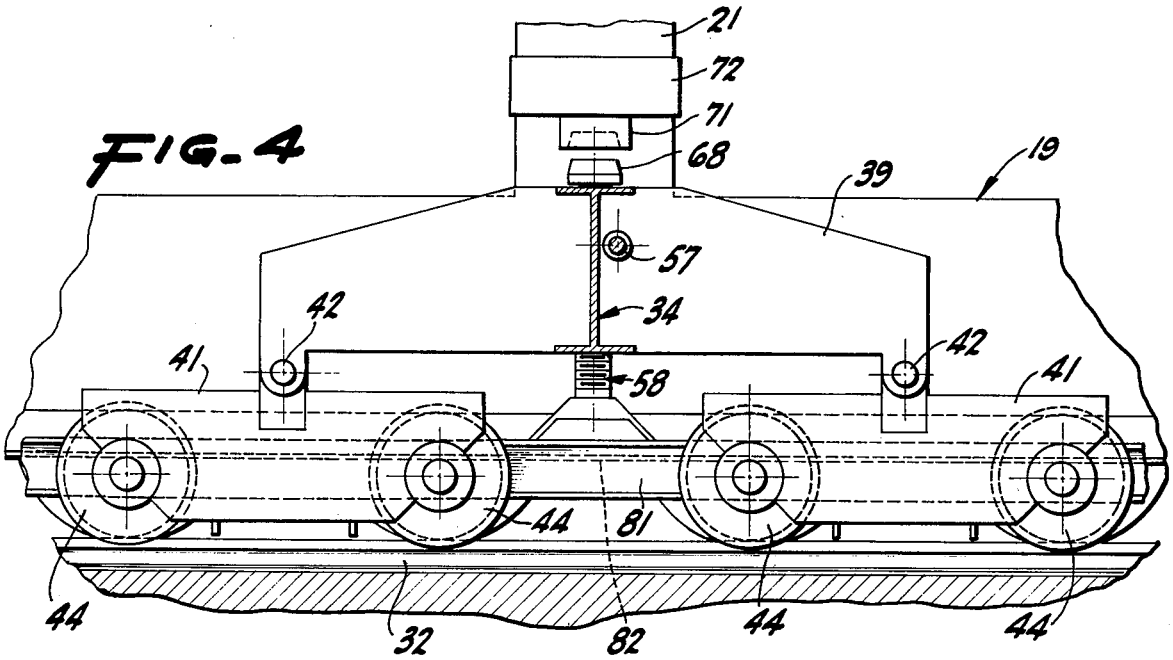
FIG. 4 is a detail in cross-section, the plane of which is indicated by the line 4—4 of FIG. 3, with certain portions broken away and other portions being omitted to clarify the showing of the figure.

As especially shown in FIG. 3, the shaft 57 terminates in a bevel gear 61 meshing with a bevel wheel 62 formed on a nut 63 internally threaded and journalled on a boss 64 extending from and secured to part of the frame 34.

Interengaging with the threads within the nut 63 is a screw shaft 66 forming part of the screw jack 58. The screw shaft 66 extends upwardly to and through a key guide 67 and ends in a tapered cap 68. When the shaft 57 is rotated by the motor 53, the bevel gear 61 similarly rotates the nut 63. Since the screw shaft 66 is restrained from rotating and is constrained simply to vertical movement, operation of the nut 63 lifts and lowers the cap 68 with respect to the mover frame.

Normally the cap is spaced away from and is in a low position with respect to the crane frame or leg 21, but upon a sufficient upward excursion the cap encounters a lifting pad 71 interposed in the vertical path of the jack screw 58 and preferably supported on a bracket 72. This is particularly added to the crane frame and conveniently extends around or at least partly around the respective one of the four legs 21 thereof. With this arrangement, when the jack screw lifts, the cap 68 engages into the complementary or hollow pad 71 and is effective to lift or to impose a lifting force on the crane leg 21. That the cap 68 is somewhat contoured or beveled and the pad is similarly hollowed or configured assists in effecting not only some vertical alignment between the parts, but also a firm interengagement against any lateral or transverse shifting thereof.

In many instances, particularly if the crane wheels 22 are interconnected by a number of equalizers, the wheels tend to drop or shift out of position when the crane leg 21 is lifted far enough to disengage the wheels and flanges from the subjacent track. To overcome any difficulty for that reason, the jack screw shaft 66 is extended downwardly and laterally and terminates in a lip 81. This conveniently can be a short section of I-beam normally arranged so that its outer flanges embrace or span an outstanding ledge 82 that is added to each of the equalizers for each of the wheel trucks, such as 19. While there is normally sufficient clearance or space between the ledge 82 and the lip 81 so that there is no inferference therebetween, yet when the jack screw has lifted the cap 68 and socketed the cap into the lifting pad 71, the lower lip is very closely spaced below the ledge 82. This permits some dropping of some of the wheels of the truck 19, but only to a very small extent, an extent much less than the height of the wheel flange. There is thus no difficulty about disengaging the various truck wheels from the subadjacent rails nor any subsequent difficulty in replacing such wheels on the proper tracks, since all corners of the structure are substantial duplicates and operate together.

When the operator works his controls in the station 51 and energizes the motor 53, all of the jacks 58 are simultaneously operated. They are interconnected mechanically, in this instance, so they are synchronized and always maintain exactly the same lifted height relationship among all four of the legs 21 of the crane frame with respect to the mover frame 34. That being true, and the mover frame being interlocked with the crane frame when the wheels 22 are off of the rails 7 and 8, for example, all of the crane weight is borne on the mover frame and its wheels 44. The crane weight is transferred from the straight tracks onto the curved tracks 31 and 32. That being true, the mover frame can be advanced along the curved tracks 31 and 32 carrying the crane bodily from its initial location into a subsequent location in registry with the tracks 9 and 10.

While movement of the mover frame 34 can be by an entirely separate towing or pushing vehicle, it is preferred to provide driving motors 83 (FIG. 2) on each of a selected one of the wheels 44 for each truck and to connect such motors to the central control station 51. This is preferably done hydraulically in a well-understood way. In this fashion, the crane is bodily moved to its new location above the tracks 9 and 10. The operator in the control 51 then energizes the motor 53 in a reverse direction and rotates the jack nuts 63 in an opposite direction synchronously and simultaneously. The screw jacks are simultaneously lowered, thus permitting the crane legs 21 to descend until the various wheels 22 are properly poised over and eventually come into contact with the subjacent rails 9 and 10. This movement of the wheels is aided by the slight play between the lip 81 and the ledge 82 of each of the units. As soon as the crane is deposited in its new location around the corner, so to speak, from its initial location and it is free from the crane mover, it can be propelled to and fro on the tracks 9 and 10 in the customary way. If desired, as an aid to repositioning the crane on the rails, the rails in the portions to receive the wheels can be narrowed somewhat so that there is a little extra leeway in accepting the wheel flanges.

Normally the crane mover can be stored on its tracks, but if space is at a premium the crane mover can be provided with hydraulically controlled, rubber-tired wheels. These can be lowered to engage the ground to support the mover weight. The mover can then be towed to a storage position away from the tracks.

We claim:

1. A crane mover for use with a crane movable on rails having an individual, separate crane frame having legs supported on transversely spaced, parallel sets of rail-engaging crane wheels comprising an individual, separate mover frame operably positioned between said legs, rail engaging mover wheels shiftable into and out of a position on said rails; said mover wheels being transversely spaced and connected to and supporting said mover frame at a set elevation below said crane and above said mover wheels; lifting pads on said crane frame overlying and spaced vertically above said mover frame; a plurality of jacks on said mover frame and movable vertically into and out of lifting engagement with said lifting pads to change the position and track engagement of said crane wheels and movers wheels; means on said mover frame for operating all of said jacks in unison; and means on said mover frame for driving said mover wheels.

2. A device as in claim 1 in which an equalizer beam interconnects at least a pair of said crane wheels for relative vertical movement, and means on said mover for engaging said beam and limiting said relative vertical movement.

3. A device as in claim 2 in which said engaging means is operated by one of said jacks.

4. A device as in claim 1 in which at least one of said lifting pads includes a laterally effective locating device and at least a corresponding one of said jacks includes a mating, laterally effective locating device.

5. A device as in claim 1 in which said crane wheels are adapted to engage straight track including a pair of parallel rails spaced a predetermined distance apart and said mover wheels are adapted to engage curved track including a pair of curved rails spaced apart a lesser distance and disposed between said parallel rails.

6. A device as in claim 1 in which at least one of said jacks has a vertically movable stem adapted to rise from a lower position toward an upper position, a lip projecting laterally from said stem and movable with said stem in a vertical path and in which at least some of said crane wheels are interconnected by a horizontally tiltable equalizer, and a ledge on said equalizer in said path above and engageable by said lip as said stem rises toward said upper position.

7. A crane mover for use with an individual, separate crane adapted to run on a pair of transversely spaced apart straight crane rails, said crane having a pair of longitudinally spaced trucks running on each of said crane rails and having a crane frame with longitudinally and transversely spaced legs each supported on one of said trucks comprising longitudinally and transversely spaced mover frame wheels running on transversely spaced apart and curved mover frame rails at least in part disposed between said straight crane rails; an individual and separate mover frame supported on said mover frame wheels and with said mover frame wheels movable on said mover frame rails between a first position under said crane and a second position away from under said crane; lifting pads on said crane legs extending toward and above said mover frame; and jacks on said mover frame in position adapted to be disposed beneath said lifting pads and vertically movable into and out of crane raising and lowering engagement therewith.

* * * * *